United States Patent [19]

Oberstrass et al.

[11] 4,370,852

[45] Feb. 1, 1983

[54] FRICTION FALSE TWISTING APPARATUS

[75] Inventors: Detley Oberstrass, Tönisheide; Wolfgang Hartig; Klaus Weber, both of Remscheid, all of Fed. Rep. of Germany

[73] Assignee: Barmag Barmer Maschinenfabrik AG, Remscheid, Fed. Rep. of Germany

[21] Appl. No.: 273,079

[22] Filed: Jun. 12, 1981

[30] Foreign Application Priority Data

Jul. 9, 1980 [DE] Fed. Rep. of Germany ..... 3025884

[51] Int. Cl.[3] ..... D02G 1/08

[52] U.S. Cl. ..... 57/340; 57/105; 57/339; 57/348

[58] Field of Search ..... 57/334–340, 57/104, 105, 348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,047,374 | 9/1977 | Venot | 57/338 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,240,248 | 12/1980 | Raschle | 57/348 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes

*Attorney, Agent, or Firm*—Bell, Seltzer, Park & Gibson

[57] ABSTRACT

A yarn false twisting apparatus is disclosed which comprises a support bracket which mounts a pair of twist imparting circular discs, and drive means including a whorl rotatably mounted to the support bracket so as to be tangentially contacted by a drive belt mounted to the central frame of a twisting machine. The support bracket is mounted to the central frame for pivotal movement through 180 degrees to thereby permit selective operation in a first position wherein S twist is imparted to the yarn, and a second position wherein Z twist is imparted to the yarn. Preferably, one of the discs is composed of a thin flexible material, and a pressure applying member is mounted on the support bracket for biasing the flexible disc toward the other disc locally at the twisting zone. In the disclosed embodiment, the discs are also adjustably movable with respect to each other, and the pressure applying member is movable in a direction perpendicular to the movement of the discs, such that the ratio of twist insertion to yarn advance speed may be varied.

5 Claims, 3 Drawing Figures

FRICTION FALSE TWISTING APPARATUS

Figure 1A:
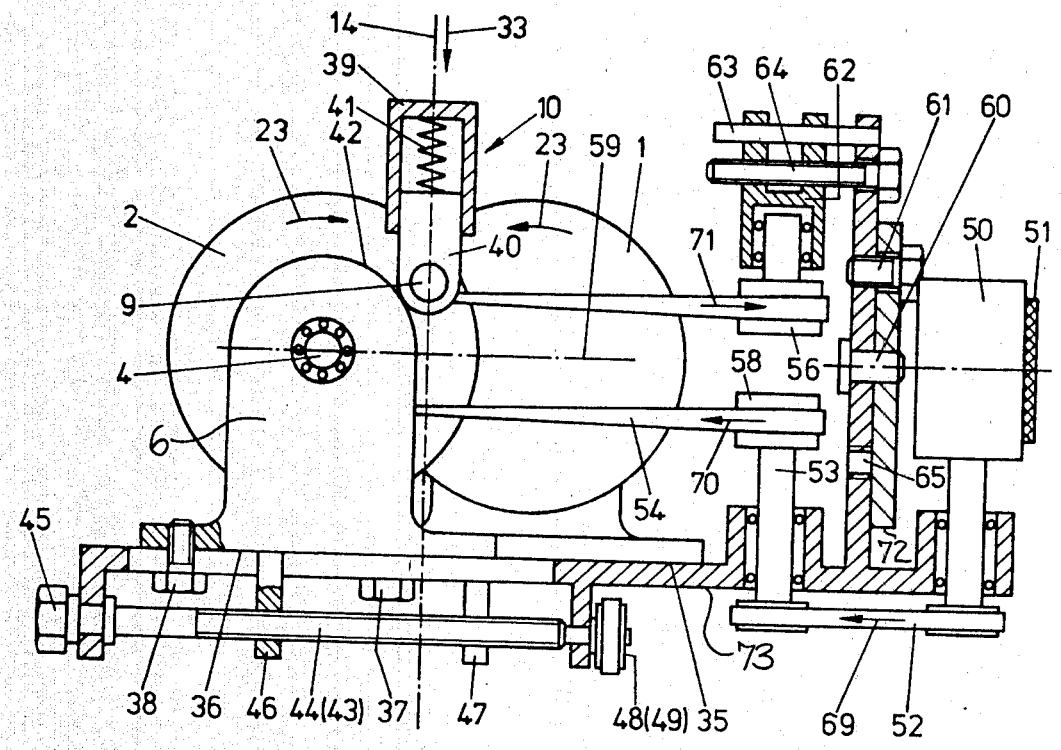

The present invention relates to an improved yarn friction false twisting apparatus, of the type disclosed in the German Patent Publication (OS) No. 2,213,881 and commonly owned copending U.S. application Ser. No. 168,734, filed July 14, 1980 and now U.S. Pat. No. 4,339,915.

Friction false twisting apparatus are known for crimping thermoplastic synthetic filaments, and which impart a twist to the yarn to be crimped by the action of frictional forces across the yarn axis. Such friction false twisting apparatus are further illustrated and described in the above referenced German Publication and U.S. patent application.

The present invention particularly relates to a yarn false twisting machine having a plurality of false twisting stations positioned in side by side relation along the length of the machine, and wherein each false twisting station is driven by a common drive belt which extends along the length of the machine and tangentially contacts a whorl mounted at each false twisting station. Each station also includes a pair of twist imparting members, and means for feeding a yarn between the twist imparting members for imparting the desired twist.

It is an object of the present invention to further develop a friction false twisting apparatus of the described type and which has provision for effectively reversing the direction of rotation of the twist imparting members for the purpose of changing the twist imparted to the yarn from S to Z, or vice versa, by a simple mechanical operation which does not involve a structural change of the friction false twisting apparatus.

These and other objects and advantages of the present invention are achieved in the embodiment illustrated herein by the provision of a false twisting apparatus which includes a support bracket, a pair of twist imparting members rotatably mounted to the support bracket, a drive whorl rotatably mounted to the support bracket and operatively connected to the twist imparting members, and means mounting the support bracket to the central frame of the machine for pivotal movement about 180 degrees about an axis which is perpendicular to the axis of the whorl and extends through the medial portion thereof. By this arrangement, the support bracket may be pivoted between a first position wherein S twist is imparted to the yarn, and a second position disposed 180 degrees from the first postion wherein Z twist is imparted to the yarn.

In the illustrated embodiment, the twist imparting members comprise a pair of circular discs which are mounted for rotation about essentially parallel spaced apart axes, and such that their respective yarn engaging friction surfaces are disposed in opposed, face to face relationship and define the twisting zone therebetween. It is preferable that the pivotal axis of the support bracket perpendicularly intersect the axis of rotation of the drive whorl and that the pivotal axis is disposed in the plane defined by the axes of rotation of the discs.

It should be noted that the axes of rotation of the discs may be arranged parallel so as to define a common plane. However, it is possible that the axes of rotation be slightly inclined by a few degrees with respect to each other, and so that the discs have their narrowest spacing in the area of the twisting zone. In such case, the surface defined by the axes of rotation is not entirely flat, but the inclination is so slight that for present purposes, they may be considered to define a common plane as such term is used in the present application.

Preferably, the axes of rotation of the discs are parallel to the drive belt in each of the first and second operative positions, and the center to center distance of the discs are preferably adjustable. By this arrangement, the ratio of twist insertion and yarn advance produced by the friction false twisting apparatus may be varied, since such a change of the center to center distance changes the transverse and axial force components acting on the yarn at the twisting zone.

The present invention is also particularly applicable to the use of friction false twisting discs, wherein one or both of the discs is made of a relatively thin and flexible material, and wherein a pressure applying member acts to locally bias the flexible disc toward the other disc only at the twisting zone. In such case, it is also provided that the pressure applying member may be adjusted for changing its distance from the common plane defined by the axes of rotation. Thus the position of the pressure applying member can be varied to adjust for changes in the distance between the discs, and so as to be positioned at the optimal twisting point.

Figure 2:
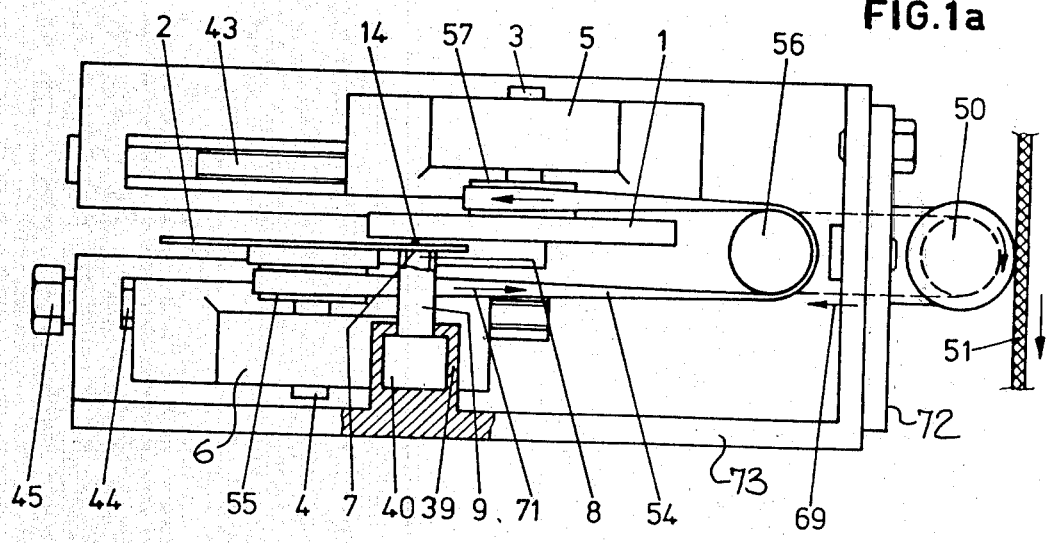

Some of the objects and advantages of the invention having been stated, others will appear as the description proceeds, when taken in connection with the accompanying drawings, in which FIG. 1 is a sectional side elevation view of a friction false twisting apparatus in accordance with the present invention, with the apparatus being disposed in the first operative position which is designed to produce an S twist in the yarn;

FIG. 1*b* is a view similar to FIG. 1*a*, but illustrating the apparatus in its second operative position for imparting a Z twist; and FIG. 2 is a top plan view, partly sectioned, of the apparatus as shown in FIG. 1*a*.

As will be understood by those skilled in the art, yarn false twisting machines typically include a plurality of twisting stations positioned in side by side relationship along the length of the machine, with each station including a false twisting apparatus as illustrated in the drawings hereof, and means for feeding a yarn through each of the twisting stations. The machine also includes a main drive belt operatively mounted to extend along the length of the frame of the machine for powering each of the twisting stations.

As specifically illustrated in the drawings hereof, the false twisting apparatus of each twisting station includes a fixed frame member 72 which is part of the central frame of the overall machine, and a support bracket 73 pivotally mounted thereto in the manner further described below. A rigid disc 1 and a flexible disc 2 are operatively mounted to the support bracket 73 by means of shafts 3 and 4 which are rotatably supported in housings 5 and 6, respectively. A pressure applying member 10 is also mounted to the support bracket, and includes a piston 8 which is movable in a cylinder 9, so as to be locally biased against the back side of the flexible disc 2 at the twisting zone or pressure surface 7. A pressurized air connection (not shown here) is also provided, and the yarn 14 is advanced in a direction perpendicular to the plane 59 defined by the two rotational axes of the shafts 3 and 4. In this regard, it will be understood that the rotational axis of the two shafts may be somewhat inclined toward each other, and so that the discs have the shortest distance from each other within the region of the pressure surface 7. Thus the plane 59 may not be precisely defined by the two axes of rotation.

The bearing housings 5 and 6 of the two discs are adjustably mounted for movement on guides 35 and 36 of the support bracket, and they may be locked in a desired position by means of the locking screws 37 and 38. For adjustment of the housings, adjusting screws 43 and 44 are provided which are drivingly connected with each other by a belt and toothed pulleys 48 and 49, and which can be rotated in either direction at the head 45 by means of a wrench. The threaded sleeves 46, 47 are fixedly connected to the housings 6 and 5, and are threadedly engaged by the screws 44, 43 respectively. By design, the threads of the screws are of opposite hand such that during the synchronized rotation of the screws, the housings 5 and 6 move in opposite directions along the guides.

During the opposed movement of the housings, the pressure applying member 10 slides on the arcuate cam surface 42 of the housing 6, with the cam surface being concentric with respect to the shaft 4. The member 10 includes a follower 40 slidably mounted in a receptacle 39 on the support bracket 73, and which is pressed against the surface 42 by spring 41. Thus, depending upon the distance between the axes of the discs, the pressure applying member 10, together with the functional elements 7, 8, 9 thereof, automatically take a position which is determined by the shape of the cam surface 42.

By the displacement of the two housings 5 and 6, and the discs 1 and 2, along the guides as described above, the ratio of twisting effect and yarn advance produced by the friction false twist apparatus on the yarn is changed. With the friction false twist apparatus positioned as shown in FIG. 1*a*, and with the direction of travel 33 of the yarn and the rotational direction 23 of the discs, the yarn receives an S twist. For changing the twisting direction, the support bracket 73 can be pivoted about the swivel pin 60 by 180 degrees, and secured by means of the holes 65 in the support bracket and screw 61. This opposite position of the friction false twist apparatus, where the yarn receives a Z twist, is shown in FIG. 1*b*.

The following description of the drive serves to explain the change from S to Z twist. The friction false twist apparatus is driven by tangential belt 51 through whorl 50, the whorl being rotatably supported in the support bracket 73 for rotation about a vertical axis. The rotation is transmitted by transmission belt 52 to the intermediate shaft 53 having a pulley 58. An endless belt 54 extends between pulley 58, disc pulley 55 for the flexible disc 2, reversing pulley 56, and disc pulley 57 for the rigid disc 1. The reversing pulley 56 is supported in a ball bearing 62, which can be displaced on guide 63 by screw 64 and positioned for tensioning the belt. When changing from S to Z twist, and vice versa, the direction of run of the tangential belt 51 is not changed, which is advantageous since crimped yarns with an S twist and a Z twist are often produced at the same time on one texturing apparatus. In FIGS. 1*a* and 1*b*, the direction of run of the tangential belt 51 is such that the belt 51 comes out of the plane of the paper, hence the illustrated directions 69, 70, 71 of movements of the belts 52 and 54, and the direction of rotation 23 of the discs.

In the drawings and specification, there has been set forth a preferred embodiment of the invention and although specific terms are employed, they are used in a generic and descriptive sense only and not for purposes of limitation.

That which is claimed is:

1. A yarn false twisting apparatus comprising a central frame, drive means including a drive belt operatively mounted to said central frame for movement along an endless path of travel, a support bracket, a pair of twist imparting members rotatably mounted to said support bracket, with each of said members including a yarn engaging friction surface, and such that portions of the respective yarn engaging friction surfaces are disposed in opposing face to face relationship and define a twisting zone therebetween, a drive whorl rotatably mounted to said support bracket and so as to tangentially contact said drive belt, means drivingly interconnecting said drive whorl and said twist imparting members, such that a yarn may be continuously advanced through said twisting zone while having twist imparted thereto by the opposed friction surfaces of said twist imparting members, and means mounting said support bracket to said central frame for pivotal movement through 180 degrees about an axis which is perpendicular to the axis of said whorl and extends through the medial portion of said whorl, to thereby permit selective operation in a first position wherein S twist is imparted to the yarn and a second position disposed 180 degrees from the first position wherein Z twist is imparted to the yarn.

2. The yarn false twisting machine as defined in claim 1 wherein said pivotal axis extends through the center of said whorl and intersects the rotational axis thereof.

3. The yarn false twisting machine as defined in claim 1 or 2 wherein said twist imparting members comprise a pair of circular discs mounted for rotation about essentially parallel axes, and wherein said pivotal axis is disposed in the plane defined by the axes of rotation of said discs.

4. The yarn false twisting machine as defined in claim 3 wherein the axes of rotation of said discs are disposed parallel to said drive belt in each of said first and second operative positions.

5. The yarn false twisting machine as defined in claim 4 wherein at least one of said discs is relatively thin and flexible, and said apparatus further comprises a pressure applying member mounted on said support bracket so as to locally bias said one flexible disc toward the other disc only at said twisting zone.

* * * * *